US006135551A

United States Patent [19]

Linder

[11] Patent Number: 6,135,551

[45] Date of Patent: Oct. 24, 2000

[54] INFLATABLE CHAIR WITH SPEAKERS

[76] Inventor: Steven G. Linder, 2 Gannet Dr., New York, N.Y. 10604

[21] Appl. No.: 09/356,071

[22] Filed: Jul. 16, 1999

[51] Int. Cl.[7] ..... A47C 4/54; A47C 7/72

[52] U.S. Cl. ..... 297/217.4; 297/452.41

[58] Field of Search ..... 297/217.1, 217.3, 297/217.4, 452.41

[56] References Cited

U.S. PATENT DOCUMENTS

| | | | |
|---|---|---|---|
| D. 112,045 | 11/1938 | Roberts . | |
| D. 187,313 | 2/1960 | Denyer . | |
| D. 193,889 | 10/1962 | Barrita . | |
| D. 227,835 | 7/1973 | Kuhlmann et al. . | |
| D. 228,595 | 10/1973 | Haynes, Sr. . | |
| D. 235,826 | 7/1975 | Jacques . | |
| D. 237,027 | 10/1975 | Bernard . | |
| D. 244,071 | 4/1977 | Haynes, Sr. . | |
| D. 244,164 | 5/1977 | Haynes, Sr. . | |
| D. 280,123 | 8/1985 | Maertin . | |
| D. 287,528 | 12/1986 | Maxwell . | |
| D. 289,075 | 3/1987 | Wolfe . | |
| D. 316,687 | 5/1991 | Wilby . | |
| D. 330,578 | 10/1992 | Cochran . | |
| D. 332,878 | 2/1993 | Warren . | |
| D. 352,835 | 11/1994 | Lowman . | |
| D. 362,347 | 9/1995 | Karl . | |
| D. 367,182 | 2/1996 | Bonaddio . | |
| D. 371,252 | 7/1996 | Chaput . | |
| D. 378,169 | 2/1997 | Yu . | |
| D. 391,774 | 3/1998 | Yu . | |
| D. 395,528 | 6/1998 | Mayer et al. . | |
| 2,150,434 | 3/1939 | Finlay . | |
| 2,350,679 | 6/1944 | Hann et al. . | |
| 2,437,602 | 3/1948 | Hann . | |
| 2,803,839 | 8/1957 | Mosley . | |
| 2,980,927 | 4/1961 | Waters, Sr. . | |
| 2,982,341 | 5/1961 | Besser . | |
| 3,265,438 | 8/1966 | Regan et al. . | |
| 3,408,107 | 10/1968 | Savage . | |
| 3,499,682 | 3/1970 | Orenstein . | |
| 3,572,836 | 3/1971 | Khanh . | |
| 3,635,528 | 1/1972 | Strom . | |
| 3,680,917 | 8/1972 | Harris . | |
| 3,712,674 | 1/1973 | Ando . | |
| 3,759,571 | 9/1973 | Korch . | |
| 4,484,781 | 11/1984 | Phelps | 297/452.41 |
| 4,836,605 | 6/1989 | Greenwood et al. . | |
| 4,932,721 | 6/1990 | Anthony . | |
| 4,979,777 | 12/1990 | Takada | 297/217.4 X |
| 5,143,055 | 9/1992 | Eakin | 297/217.4 X |
| 5,335,968 | 8/1994 | Sheridan et al. . | |

FOREIGN PATENT DOCUMENTS

| | | | |
|---|---|---|---|
| 3029218D | 12/1994 | China . | |
| 1259088 | 3/1961 | France | 297/217.4 |

OTHER PUBLICATIONS

Fairfield Chair Company 1994 catalog w/fabric in numerical order sheet.
Fairfield Chair Company 1992 catalog.
Alvimar Unmarked green chair with oval beam.
Web site pages from http://fullmall.com/furniture.html for inflatable chairs.
Design Store catalog.
Newspaper article from Palm Beach Post.
Creative—The Magazine of Promotion and Marketing, vol. 26, No. 4 chair at top left, Oct. 1994.
Alvimar's Apr./May 1998 advertisement in Creative—The Magazine of Promotion and Marketing.

*Primary Examiner*—Peter R. Brown
*Attorney, Agent, or Firm*—Amster, Rothstein & Ebenstein

[57] ABSTRACT

An inflatable chair having a seat member with an inflatable chamber and reinforced by one or more braces extending between a bottom panel and top panel of the seat member, and a backrest member having an inflatable chamber reinforced by one or more braces extending between a front panel and back panel of the backrest. The backrest also includes a pair of oppositely disposed pockets which are mounted within the inflatable backrest chamber and adapted to receive a pair of speakers. A wiring system is also provided for connecting the speaker to one of at least an external music source and television.

16 Claims, 7 Drawing Sheets

INFLATABLE CHAIR WITH SPEAKERS

BACKGROUND OF THE INVENTION

1. Field of the Invention

This invention relates generally to an inflatable chair, and in particular to an inflatable chair including at least one built in speaker.

2. Description of the Prior Art

Over the recent years, inflatable chairs have become very popular, especially among pre-teens, teenagers and young adults. As a result, inflatable chairs are found at the office and at home in almost every room including the den, family room and bedroom. Inflatable chairs have become so popular that inflatable furniture (e.g., inflatable end tables and ottomans) to accompany the inflatable chairs is now also available.

Inflatable chairs are popular in part because of their overall comfort and unique and stylish appearance. After a day of school and/or work, a typical user of these chairs (e.g., teenager) will return home and relax in the inflatable chair while watching television or listening to music on a stereo or portable music source. If a portable music source is used, the music is typically listened to with a set of headphones. Although headphones are necessary and convenient outside of the household, they can be uncomfortable and isolating when used indoors. If headphones are not used, the volume of the stereo or television (or sometimes both) is often turned up very loudly, generally disturbing the entire household.

Thus a need continues to exist for an inflatable chair which permits a user to watch TV or listen to music without having to use headphones and without disturbing others. Accordingly, an inflatable chair is disclosed having at least one built in speaker and a connection which can be connected to an external music source or television.

SUMMARY OF THE INVENTION

It is an object of the invention to provide an inflatable chair which is both comfortable and stylish.

It is a further object of the invention to provide a comfortable and stylish chair which is internally reinforced.

It is still a further object of the invention to provide an inflatable chair which incorporates built in speakers and a wiring system such that the built in speakers may be used with an external music source or television set.

According to the present invention, there is provided an inflatable chair which comprises a seat member having an inflatable seat member chamber defined by a bottom panel and top panel wherein the seat member chamber is divided by one or more braces or cross members connected between the bottom and top panels. The braces define sub-chambers or channels within the seat member chamber which provide shape, stability and support to the seat member. The inflatable chair further comprises a backrest having an inflatable backrest chamber which is formed between a front panel and rear panel and which is also divided by one or more braces connected between the front and rear panels within the inflatable backrest chamber. The backrest further contains at least one speaker which at least partly extends within the inflatable backrest chamber and is housed within a pocket which is independent of and sealed off from the inflatable backrest chamber. By sealing off the pocket from the inflatable backrest chamber, the backrest chamber may be inflated without a loss of air through the pocket.

In a preferred configuration, the backrest contains two speakers each mounted in separate pocket and a wiring system which extends from each of the speaker pockets within at least one inflatable backrest chamber to an exit point provided in an outside wall of the inflatable chair. Preferably, the wiring system extends from the pockets within the inflatable backrest and seat member chambers to an exit point located in an out of the seat member. The wiring system includes a jack which may be used to connect the speakers to one of at least an external music source and television. The wiring system is preferably contained within a flexible conduit which extends between the pockets containing the speakers and the exit point in the wall of the inflatable chair.

In an alternate embodiment, the backrest may include separate inflatable speaker chambers contiguous with the backrest and adapted to receive and mount the speakers.

BRIEF DESCRIPTION OF THE DRAWINGS

These and other objects, features and advantages of the invention, its construction and operation will be best understood from the following detailed description, taken in conjunction with the accompanying drawings, of which.

DESCRIPTION OF THE PREFERRED EMBODIMENTS

Figure 1:
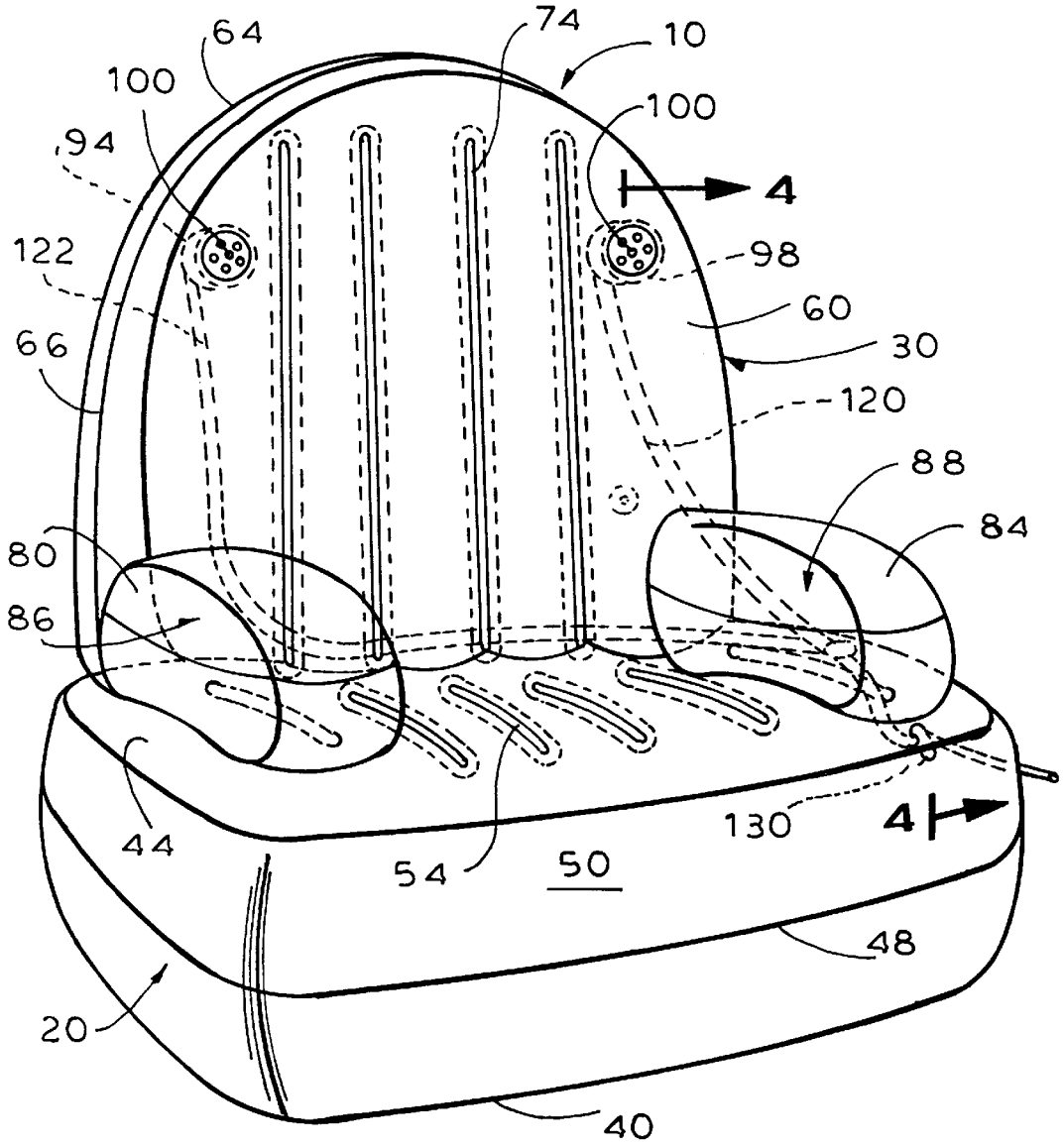
FIG. 1 is a perspective view of an inflatable chair with built in speakers according to a first embodiment of the invention.
Figure 2:
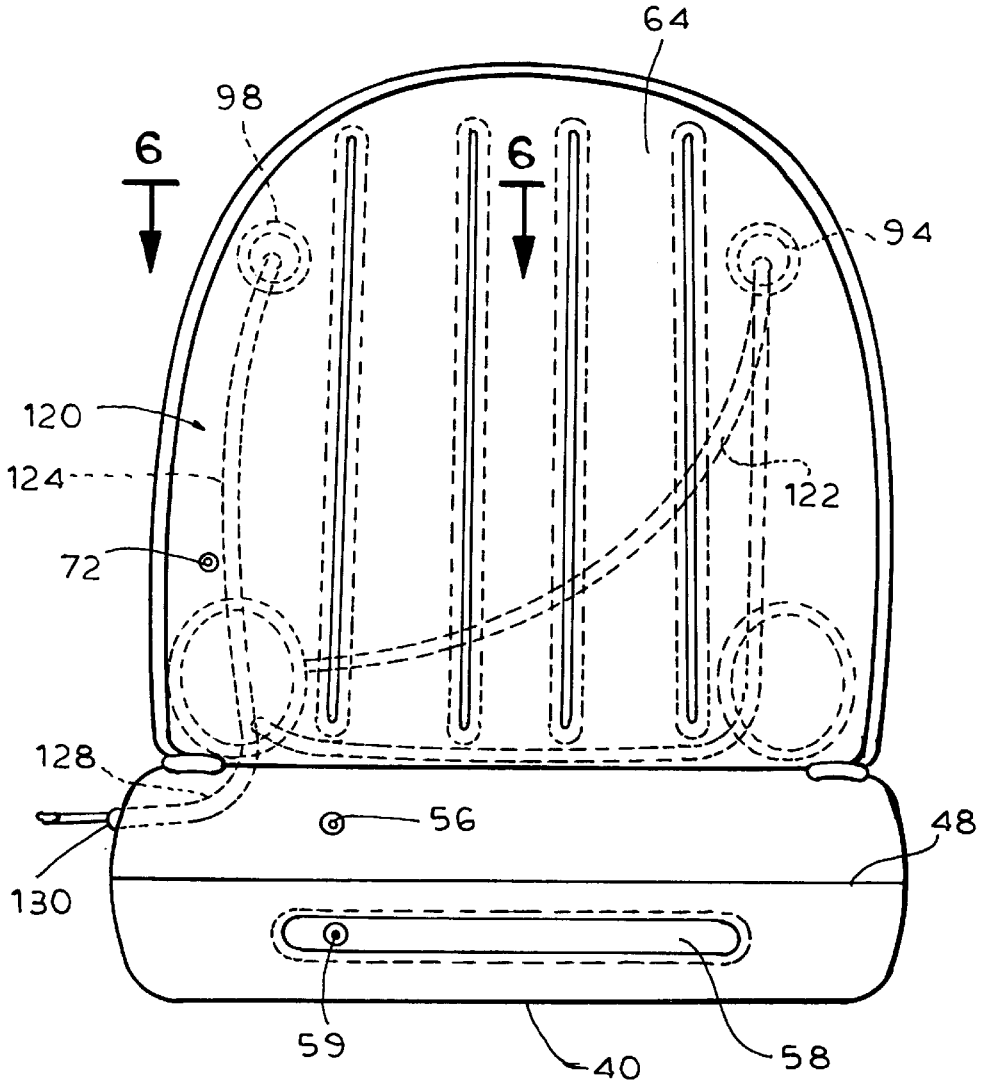
FIG. 2 is a rear view thereof showing the wiring system and one or more speakers of the present invention in phantom.
Figure 3:
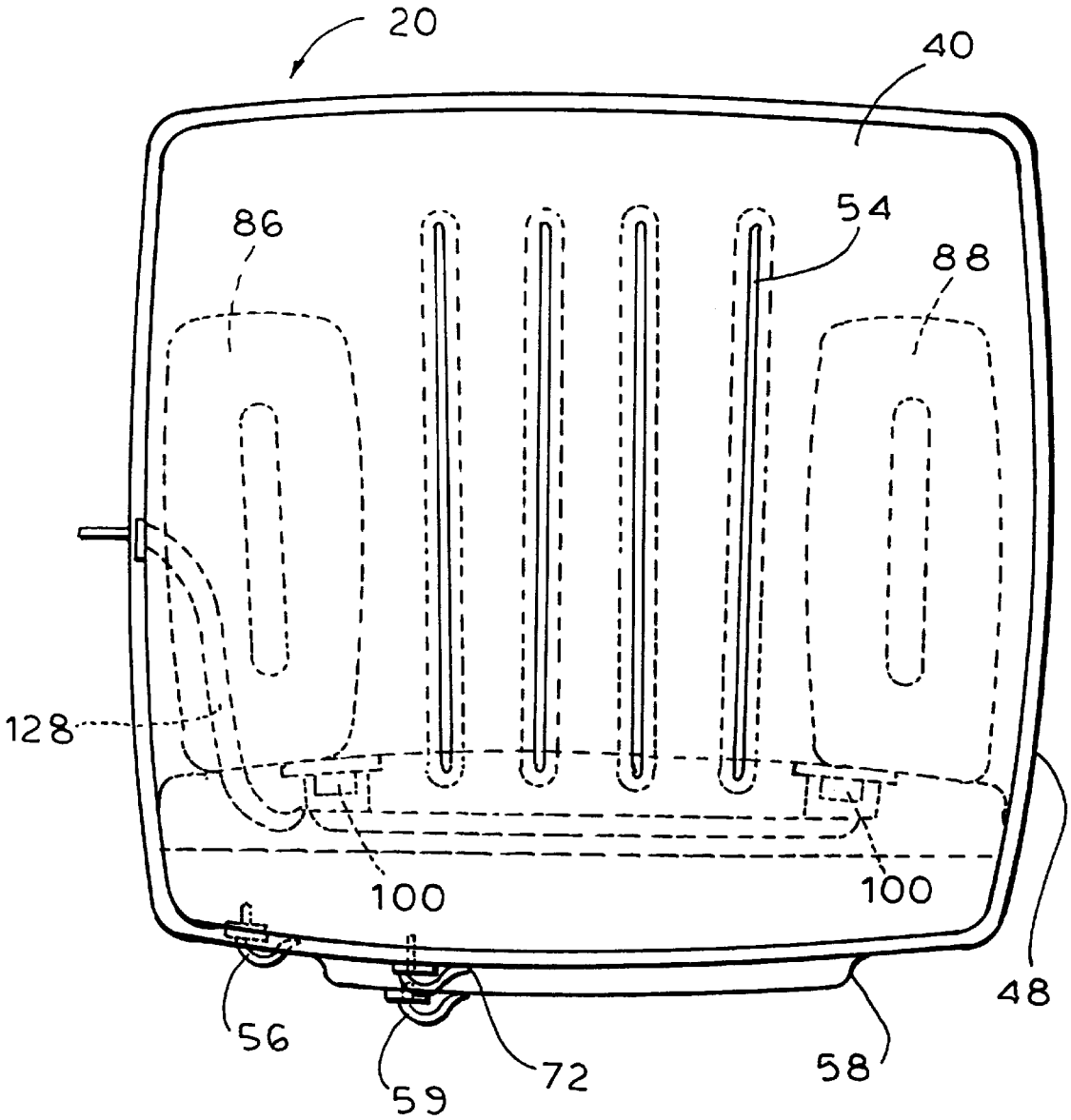
FIG. 3 is a bottom view thereof.

Now referring to the drawings, and particularly FIGS. 1–3, an inflatable chair 10 is shown as generally comprising a seat member designated generally at 20 and a backrest designated generally at 30. The inflatable chair 10 is preferably made of a vinyl, flock vinyl, vinyl having a nylon face or combinations thereof.

The seat member 20 is comprised of a bottom panel 40 and a top panel 44 preferably welded together at seam 48 to form an inflatable seat chamber 50. The inflatable seat chamber 50 is subdivided by a plurality of flexible beams or braces 54 which extend between the bottom panel 40 and top panel 44 to form channels or sub chambers which act to stiffen and reinforce the seat member 20. As shown in FIG. 3, the seat chamber 20 may be inflated through a valve 56 located at the rear of the seat adjacent to bottom panel 40. Since the braces 54 preferably do not extend entirely across the chamber 50, the formed channels or sub-chambers are open at one or both ends. As a result, when a weight is applied (i.e., a person sits down) to the seat member 20 air is distributed between and around the channels or sub-chambers more evenly and effectively absorbing the weight.

As a means of supporting the chair 10 in an upright position, the chair 10 also preferably includes an inflatable stabilizer chamber 58, inflatable through valve 59.

Figure 6:
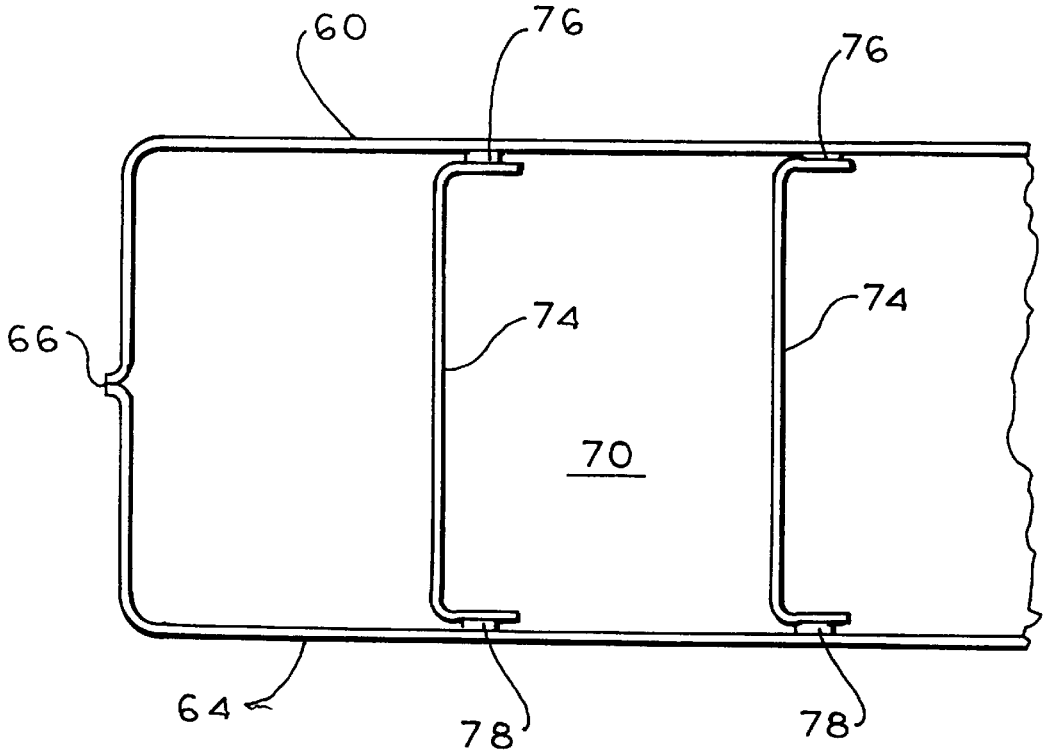
FIG. 6 is a sectional view taken along the line 6—6 of FIG. 2.

The braces 54 are preferably constructed of thin sheets of vinyl having free edges which are welded to the interior of the bottom and top panels 40, 44, respectively as shown if FIG. 6. Alternatively the braces may have an I-beam or O-beam construction for welding between the bottom and top panels 40, 44.

Also, although not as desirable, the bottom and top panels 40, 44 may be welded to each other at spaced intervals, in place of the braces 54, so as to form a plurality of sub chambers within inflatable seat chamber 50 to stiffen and reinforce the seat member 20.

As shown in FIGS. 1 and 2, the backrest 30 of the inflatable chair 10 is comprised of a front panel 60 and rear panel 64 welded together at seam 66 to form an inflatable backrest chamber 70. A valve 72 is provided in the backrest 30 for inflating the backrest chamber 70. Like the inflatable seat 50, the inflatable backrest chamber 70 includes a plurality of braces 74 which extend between the front panel 60 and rear panel 64 to stiffen and reinforce the backrest 30. The braces 74 preferably have the same general construction and alternative construction as described before. As shown in FIG. 6, the braces 74 are welded at weld points 76, 78 between the front and rear panels 60, 64 and extend vertically for substantially the entire height of the backrest 30. Alternatively, the braces may extend transversely for substantially the entire width of the backrest. In either case, the braces 74 form sub chambers or channels within the inflatable backrest chamber 70 which stiffen and reinforce the backrest 30.

The inflatable chair 10 further includes a pair of armrests 80, 84 having inflatable armrest chambers 86, 88, respectively, formed therein. The armrests 80, 84 are welded at a bottom side thereof to the top panel 44 of the seat member 20. The inflatable chambers 86, 88 of the armrests 80, 84, preferably, do not communicate with inflatable seat chamber 50 of the seat member 20. Each of the armrests 80, 84 are also welded at one end to the front panel 60 of the backrest 30. The inflatable armrests chambers 86, 88 preferably communicate with the inflatable backrest chamber 70 through holes or openings (not shown) provided in the front panel 60 of backrest 30. In this manner inflatable backrest chamber 70 and armrest chambers 86, 88 are inflated as a single unit.

It should be apparent that since seat member 20 and backrest 30 are separate and independent that armrests 80, 84 also function to join or attach the seat member 20 and backrest 30 such that a user of the chair 10 is supported by the backrest 30 while sitting on the seat member 20. Alternatively, seat member 20 and backrest 30 may be joined at a seam such that the inflatable backrest chamber 70 and inflatable seat chamber 50 may be inflated as a single unit through a single valve.

Of course, each of the armrests may be formed as an integral structure with the seat member 20 or backrest 30 such that the armrests and seat chambers or armrests and backrest chambers could be inflated as a single unit. Alternatively, the armrests 80, 84 could remain as separately formed chambers which are in communication with the seat member 20 rather than the backrest 30 (as disclosed) such that the armrests 80, 84 and seat member 20 are inflatable as a single unit. Although not shown, at least one of the armrests 80, 84 may include pockets or wells formed therein which can be used to hold at least one of a portable music source, remote control unit and beverage.

As shown in FIGS. 1–4, the backrest 30 further includes left and right pockets 94, 98 for mounting speakers 100 to be connected to an external television or external music source such as, for example, a stereo, radio, CD player or tape player. More particularly, the front panel 60 of backrest 30 supports speakers 100, 100 within separate left and right pockets 94, 98 which are preferably welded to the inside of the front panel 60 of the backrest 30 and are not in communication with the inflatable backrest chamber 70.

Figure 4:
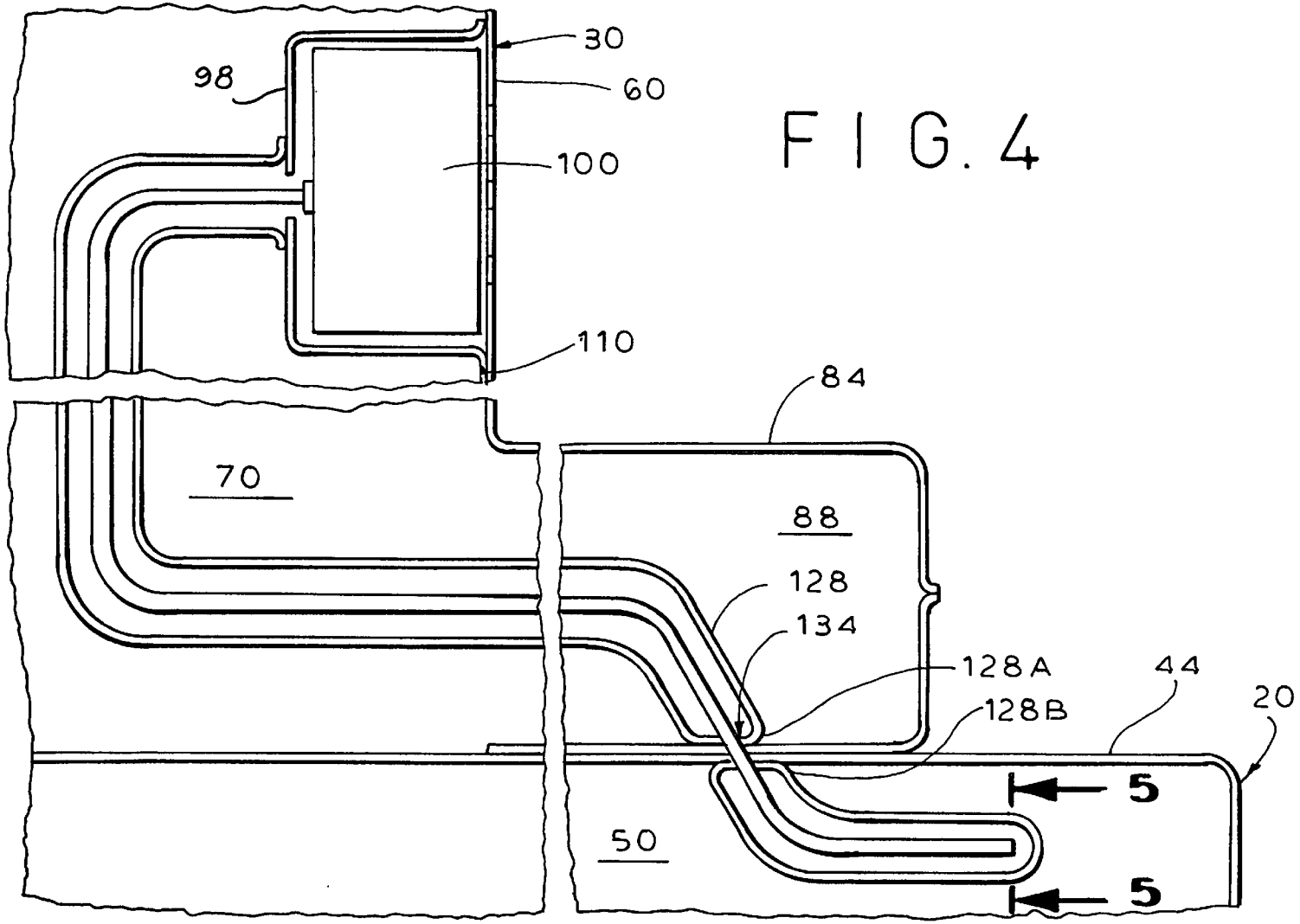
FIG. 4 is a sectional view taken along the line 4—4 of FIG. 1.
Figure 5:
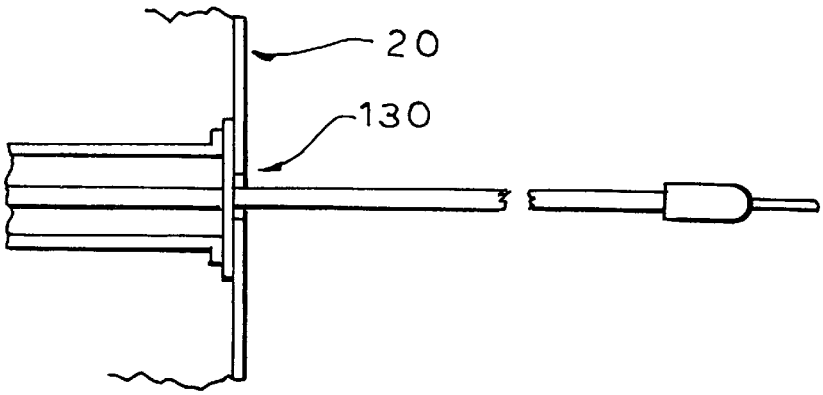
FIG. 5 is a sectional view taken along the line 5—5 of FIG. 4.

As shown in greater detail in FIG. 4, each of the pockets 94, 98 which is adapted to receive the speakers 100, 100 includes a rim 110 which is preferably welded to an inner surface of the front panel 60 to form an airtight seal between the pockets 94, 98 which communicate with the outside environment and the inflatable backrest chamber 70. Preferably, the portion of the front panel 60 which confronts the face plate of the speaker, includes a plurality of openings or a separate grill plate which permit the sound from the speaker to exit the pocket into the surrounding environment without being muted or muffled by the front panel 60.

The inflatable chair 10 also preferably includes a wiring system enclosure which, as shown in FIGS. 1 and 2, is generally a Y-shaped conduit shown generally at 120 having separate conduit arms 122, 124 which are preferably welded at one end to each pocket 94, 98 within the inflatable backrest chamber 70 and merge at their other ends into a single conduit segment 128 which extends within the inflatable chair 10 to an exit point shown generally at 130 in a wall of the inflatable chair 10. As shown, each of the conduit arms 122, 124 are preferably welded at one end to pockets 94, 98, respectively, to form an airtight seal therewith. At the exit point, the conduit segment 128 is welded to a wall of the seat member 20. Although the wiring system enclosure is shown in the preferred embodiment as running within the boundaries of the inflatable chair 10 (i.e., within the inflatable chambers of the backrest and seat member), the wiring system enclosure alternatively may be mounted to the exterior of the inflatable chair such as, for example, along the back side of the inflatable chair 10.

As shown in greater detail in FIG. 4, preferably, the conduit segment 128 extends into the inflatable armrest chamber 88. An opening or hole shown generally at 134 is provided in a wall of the armrest 84 and top panel 44 of the seat member 20 through which the conduit segment 128 may pass into the inflatable seat chamber 50 to the exit point 130 in seat member 20. Since opening 134 is provided in armrest 84 and seat member 20 which would otherwise permit communication between inflatable armrest chamber 88 and inflatable seat chamber 50, conduit segment 128 is bisected and one free end 128A is welded around the opening to a wall of arm rest 84 within inflatable armrest chamber 88 while the other free end 128B is welded to the inside of top panel 44 within inflatable seat chamber 50. By welding the ends in this manner, Y-shaped conduit 120 is only in communication with pockets 94, 98 but not in communication with inflatable seat member and backrest chambers 50, 70. In effect a separate and independent passage is created within conduit 120 through which air from inflatable seat member and backrest chambers 50, 70 may not escape into the environment.

As shown in FIGS. 1–4, a Y-shaped speaker wiring system is led out from the pockets through the Y-shaped conduit to the exit point and out into the environment where the speaker wire (having a conventional connector) may be connected to the television or external music source. Although the speaker wire may exit through the seat member 20 (as shown), other configurations are possible such as, for example, where the speaker wire is led out through an exit point in the backrest 30 or armrests 80, 84.

Figure 7:
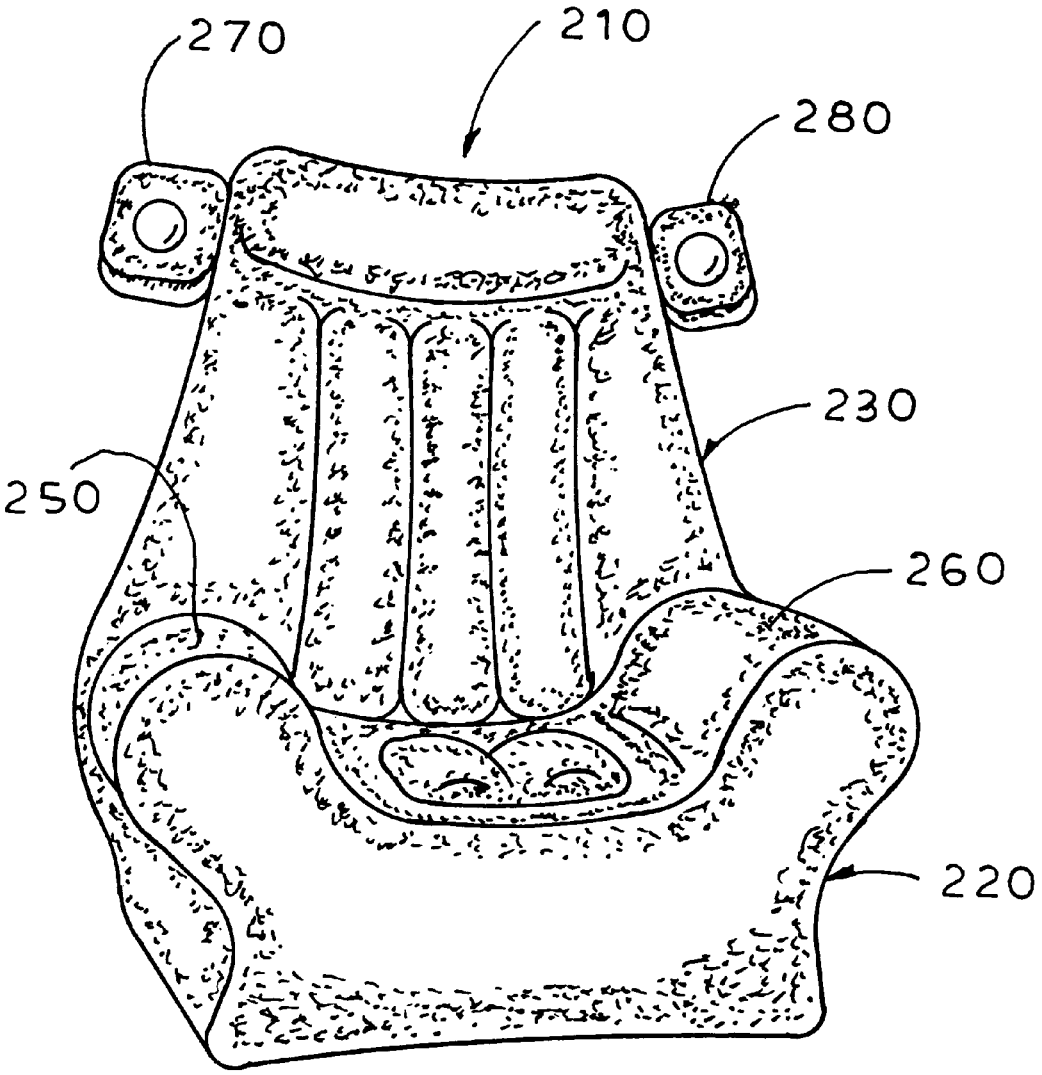
FIG. 7 is a perspective view of an inflatable chair in accordance with a second embodiment of the present invention.

FIG. 7, refers to a second embodiment of an inflatable chair shown generally at 210 generally comprising a seat member shown generally at 220 and a backrest shown generally at 230. The seat member 220 and backrest 230 include inflatable seat member and backrest chambers 240, 244, respectively which are reinforced by braces as has been shown and disclosed in connection with the previous embodiment of the present invention. The seat member 220 preferably includes integrally formed armrests 250, 260 which are welded at one end to a front panel of the backrest 230. The inflatable seat member chamber 240, armrests 250, 260 and inflatable backrest chamber 244 are in communication to form a single inflatable unit. As previously discussed, any number of configurations are possible.

The backrest 230 includes a pair of oppositely disposed speaker chambers 270, 280 which are preferably in communication with the backrest 230 and inflatable therewith. Within each speaker chamber is preferably mounted a pocket (as has been disclosed) which has an opening adapted to receive a speaker. The pockets are sealed off from the speaker chambers and backrest chamber. As before, each pocket is preferably welded to a portion of the speaker chamber to form an airtight seal between the pocket and inflatable backrest chamber.

Figure 8:
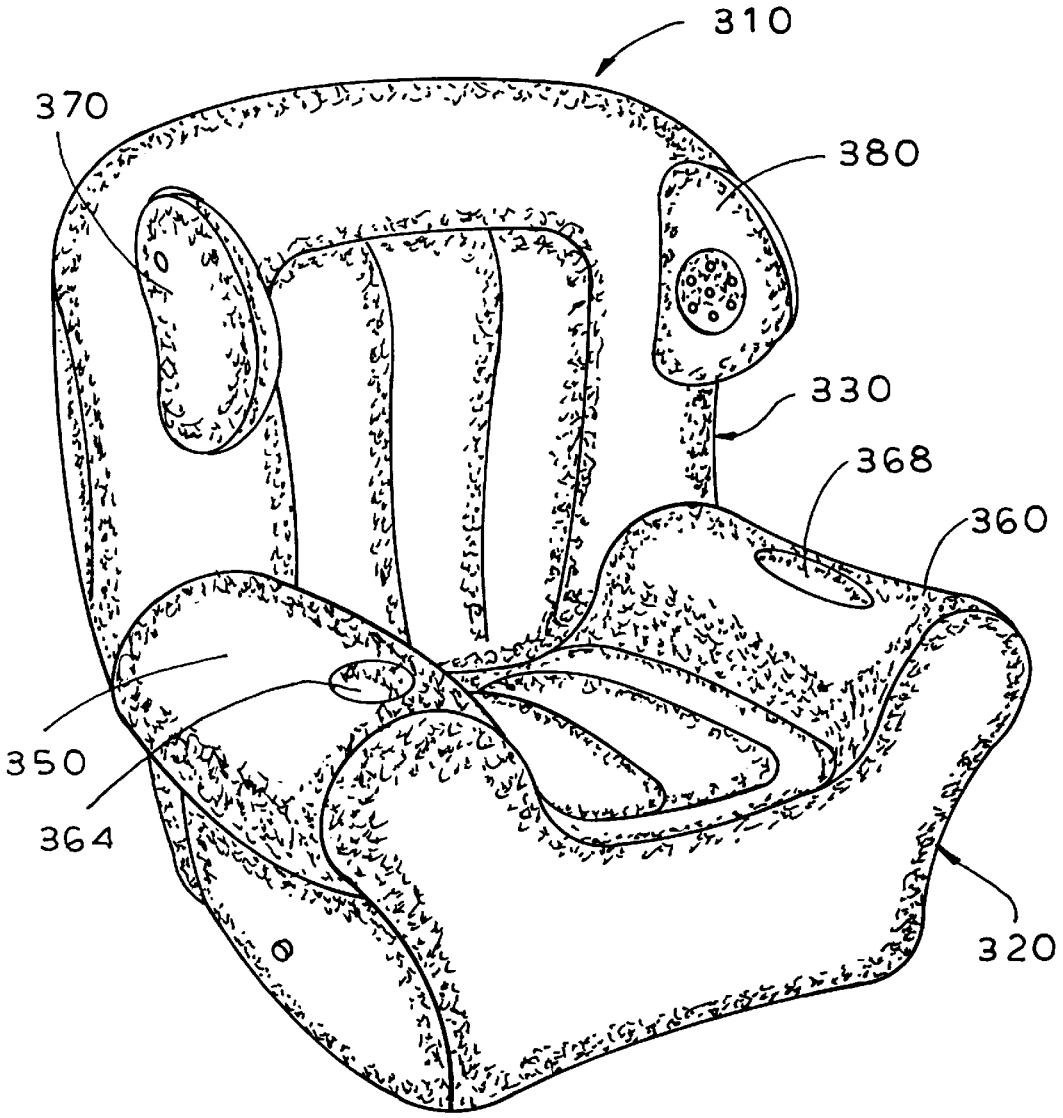
FIG. 8 is a perspective view of an inflatable chair in accordance with a third embodiment of the present invention.

FIG. 8 refers to a third embodiment of an inflatable chair shown generally at 310 generally comprising a seat member shown generally at 320 and a backrest shown generally at 330. The seat member 320 and backrest 330 are reinforced such as has been shown and disclosed in connection with the previous embodiment of the present invention. The seat member 320 preferably includes integrally formed armrests 350, 360 which are welded at one end to a front panel of the backrest 330. The seat member 320 with integral armrests and backrest 330 are preferably in communication to form a single inflatable unit. However, as previously discussed, any number of configurations are possible. The armrests 350, 360 preferably also include recesses 364, 368 for receiving one of at least a beverage, portable music source and a remote control.

The backrest 330 includes a pair of speaker chambers 370, 380 extending perpendicularly from the backrest 330 and preferably in communication and inflatable therewith. Within each speaker chamber 370, 380 is preferably mounted a pocket (as has been disclosed) which has an opening adapted to receive a speaker. The pockets are sealed off from the speaker chambers 370, 380 and backrest 330. As before, each pocket is preferably welded to a portion of the speaker chamber to form an airtight seal between the pocket and inflatable backrest chamber.

Now that the preferred embodiments of the present have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A chair having at least one speaker mounted within an inflatable chamber of said chair comprising:

a seat member having an inflatable seat chamber formed between a bottom panel and a top panel of said seat member, said seat member further including one or more braces connected between said bottom panel and said top panel such that when said inflatable seat chamber is inflated said one or more braces connecting said bottom and top panels define sub-chambers within said inflatable seat chamber which act to reinforce said seat member;

a back rest having an inflatable backrest chamber formed between a front panel and a rear panel, said backrest further including one or more braces connected between said front panel and rear panel such that when said inflatable backrest chamber is inflated said one or more braces connecting said front and rear panels define sub-chambers within said inflatable backrest chamber which reinforce said backrest;

said seat member and backrest being joined together such that said backrest is oriented substantially perpendicular to said seat member;

at least one pocket mounted to said backrest and extending at least partly within said inflatable backrest chamber and having an opening for receiving and mounting said at least one speaker, said at least one pocket being sealed off from said inflatable backrest chamber such that said inflatable backrest chamber is inflatable without loss of air further including through said at least one pocket; and a means for connecting said at least one speaker to at least one of an external music source and television.

2. The chair of claim 1 further comprising at least one inflatable armrest.

3. The chair of claim 2 wherein said inflatable armrest is in communication with said inflatable backrest chamber such that said inflatable backrest chamber and inflatable armrest chamber are inflatable as a single unit.

4. The chair of claim 2 wherein said inflatable armrest includes one or more recesses for holding one of at least a television remote control, external music source and beverage.

5. The chair of claim 1 wherein said inflatable seat rest chamber and said inflatable backrest chamber are not in communication and thus separately inflatable.

6. The chair of claim 1 wherein said inflatable seat rest chamber and said inflatable backrest chamber are inflatable as a single unit.

7. The chair of claim 1 wherein said backrest further comprises at least one inflatable speaker chamber contiguous with said backrest for mounting said at least one pocket and said at least one speaker.

8. The chair of claim 7 wherein said inflatable speaker chamber is perpendicular to the plane formed by said front panel of said backrest.

9. The chair of claim 7 wherein said inflatable speaker chamber is coplanar with the plane formed by said front panel of said backrest.

10. The chair of claim 1 further comprising an inflatable stabilizer chamber for helping to maintain said chair in an upright position.

11. The chair of claim 1 wherein said means for connecting said at least one speaker to one of at least an external music source and television includes a Y-shaped speaker wire enclosed in a Y-shaped conduit which extends at least within said inflatable backrest chamber to an exit point in a wall of said inflatable chair.

12. An inflatable chair adapted to receive and mount a pair of speakers and associated wiring system comprising:

a seat member having an inflatable seat chamber formed between a bottom panel and a top panel of said seat member;

a backrest having an inflatable backrest chamber formed between a front panel and a rear panel;

said seat member including means for stiffening and reinforcing said seat member;

said backrest including means for stiffening and reinforcing said backrest;

said inflatable seat member and backrest being joined together such that said backrest is substantially perpendicular to said inflatable seat member;

said backrest including separate speaker chambers independent of and isolated from said inflatable backrest chamber for receiving and mounting each of said speakers within a portion of said backrest; and means for leading out said wiring system from said speakers at least through said inflatable backrest chamber to an exit point in a wall of said inflatable chair for connection to one of at least a television and an external music source.

13. The chair of claim 12 wherein said means for leading out said wiring system includes a conduit which extends within said inflatable backrest chamber between said separate speaker chambers and said exit point in said inflatable chair.

14. The chair of claim 12 wherein each of said speaker chambers further comprise pockets for receiving said speakers mounted to said front panel of said backrest and extending at least partly within said inflatable backrest chamber such that said speaker chambers are formed between said pocket and a portion of said front panel of said backrest.

15. The chair of claim 12 wherein said speaker chambers and speakers extend substantially perpendicularly from said front panel of said backrest chamber.

16. The chair of claim 12 wherein said speaker chambers and speakers extend from opposite side edges of said backrest chamber.

* * * * *